United States Patent [19]

Franke

[11] Patent Number: 4,467,797

[45] Date of Patent: Aug. 28, 1984

[54] BREATHING EFFORT REDUCTION DEVICE FOR SCUBA GEAR

[76] Inventor: David M. Franke, 714 Keyes, Menasha, Wis. 54952

[21] Appl. No.: 216,663

[22] Filed: Dec. 15, 1980

[51] Int. Cl.[3] ..... A62B 7/04

[52] U.S. Cl. ..... 128/204.26; 128/200.29

[58] Field of Search ..... 128/200.29, 201.11, 128/201.27, 201.28, 204.26, 204.27, 205.24; 137/DIG. 9

[56] References Cited

U.S. PATENT DOCUMENTS

| | | | |
|---|---|---|---|
| 2,747,572 | 3/1956 | Gagnan | 128/207.16 |
| 2,758,596 | 8/1956 | Cupp | 128/204.26 |
| 2,764,151 | 9/1956 | Cupp | 128/204.26 |
| 2,878,807 | 7/1963 | Gagnan | 128/204.26 |
| 3,095,890 | 7/1963 | Cousteau et al. | 128/204.26 |
| 3,147,752 | 9/1964 | Cousteau et al. | 128/207.14 |
| 3,179,118 | 4/1965 | Mitchell et al. | 137/63 |
| 3,216,416 | 11/1965 | Mitchell | 128/204.26 |
| 3,236,250 | 2/1966 | Colombo | 137/64 |
| 3,329,158 | 7/1967 | Geiszler | 128/204.26 |
| 3,348,538 | 10/1967 | Benzel | 128/204.26 |
| 3,375,839 | 4/1968 | Crenshaw | 128/205.24 |
| 3,415,245 | 12/1968 | Yamamato et al. | 128/200.29 |
| 3,474,782 | 10/1969 | Cupp | 128/200.29 |
| 3,480,011 | 11/1969 | Cousteau et al. | 128/204.26 |
| 3,521,626 | 7/1970 | Hashimoto et al. | 128/200.29 |
| 3,570,808 | 3/1971 | Wren | 128/204.26 |
| 3,633,611 | 5/1969 | MacNiel | 137/494 |
| 3,716,053 | 3/1971 | Almovist et al. | 128/204.26 |
| 3,721,235 | 3/1973 | Ball et al. | 128/200.29 |
| 3,858,615 | 1/1975 | Weigh | 128/204.18 |
| 4,002,166 | 4/1975 | Oliver | 128/204.26 |
| 4,010,746 | 8/1971 | Pedersen | 128/204.26 |
| 4,029,092 | 9/1973 | Morgan | 128/201.11 |
| 4,056,098 | 1/1976 | Michel et al. | 128/204.22 |
| 4,062,356 | 12/1974 | Merrifield | 128/205.22 |

FOREIGN PATENT DOCUMENTS

| | | | |
|---|---|---|---|
| 69970 | 1/1959 | France | 128/201.11 |
| 1515610 | 1/1968 | France | 128/201.11 |
| 857661 | 1/1961 | United Kingdom | 128/204.26 |
| 251373 | 1/1970 | U.S.S.R. | 128/200.29 |

*Primary Examiner*—Henry J. Recla

*Attorney, Agent, or Firm*—Todd S. Parkhurst

[57] ABSTRACT

A breathing exertion reduction device for attachment to the air delivery regulator of an open circuit self-contained underwater demand breathing apparatus is disclosed. The device comprises, in one embodiment, a conduit or tube connected to a regulator exhaust port, and extending generally upwardly to a conduit exhaust end. The conduit has an effective vertical height not substantially greater than the head of a column of water sufficient to produce a continuous free-flow condition of the regulator. In another embodiment, a branch conduit extends from the main conduit back to the regulator to provide parallel pressure reduction. Other embodiments of the device are adopted to reduce breathing effort with other types of regulators.

15 Claims, 17 Drawing Figures

BREATHING EFFORT REDUCTION DEVICE FOR SCUBA GEAR

BACKGROUND OF THE INVENTION

This invention relates generally to self-contained underwater breathing apparatus, and more particularly concerns devices for reducing the physical effort required to use an open circuit, two-stage demand underwater breathing device in an underwater environment.

The use of self-contained underwater breathing apparatus . A flexible hose leads from the first stage valve to another pressure-sensitive valve (called a second-stage regulator) carried by the driver's mouth. By alternately inhaling air through the valve from the hose, and exhaling through the valve to the surrounding water, the diver can breath under water for long periods of time. Designs for second stage regulators are shown in U.S. Pat. Nos. 3,633,611 and 4,010,746 and in others. The mechanics of valve operation have seemed to require the diver to exert at least a small amount of positive, usually conscious effort to inhale and exhale through the second stage regulator. This breathing effort results in diver lung fatigue and loss of diver efficiency.

It is accordingly the general object of the present invention to provide a breathing effort reduction device for use with the air delivery regulator of an open circuit self-contained underwater demand breathing apparatus. A related object is to offer such a device which provides this breathing effort reduction when the diver is in the most common diver body orientations or positions, and which does not adversely affect diver breathing efforts when the diver is in the other body orientations or positions.

Another object is to provide a diver breathing effort reduction device which operates effectively at various water depths and at various breathing rates, yet which does not reduce diver comfort.

Another object is to provide a breathing effort reduction device which is in inexpensive to manufacture and reliable and rugged in operation.

Yet another object is to provide a breathing effort reduction device which, in its various embodiments, can be used with any commercially available scuba regulator.

Other objects and advantages of the invention will become apparent upon reading the following detailed description and upon reference to the drawings. Throughout the drawings, like reference numerals refer to like parts.

DETAILED DESCRIPTION

While the invention will be described in connection with several aspects of a preferred embodiment, it will be understood that it is not intended to limit the invention to this embodiment. On the contrary, it is intended to cover all alternatives, modifications and equivalents as may be included within the spirit and scope of the invention as defined by the appended claims.

Figure 1:
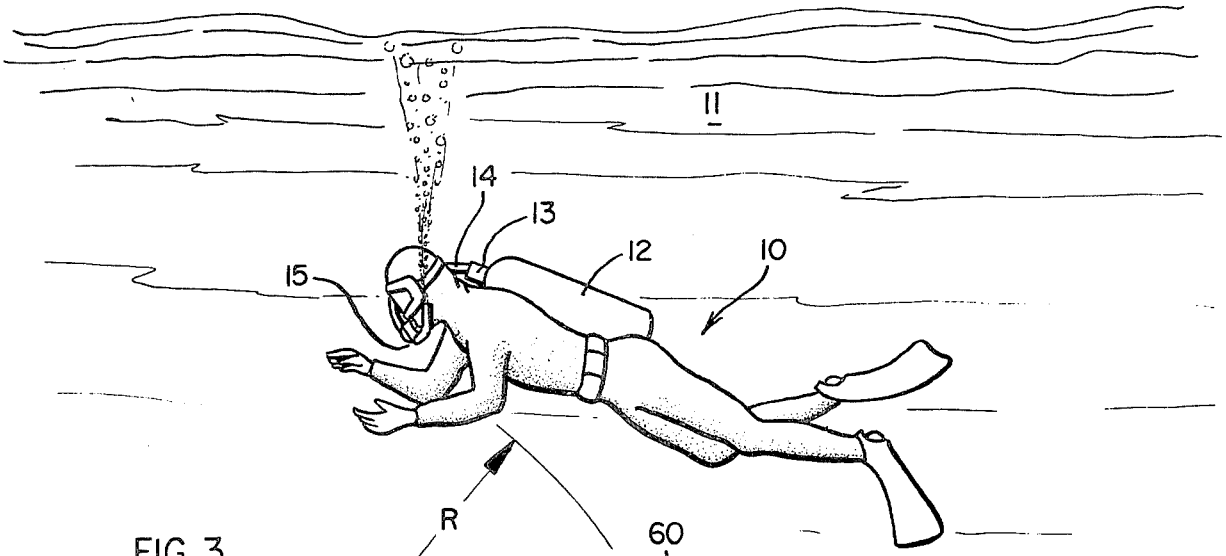
FIG. 1 is a side elevational view showing a typical diver in an underwater environment who is using typical scuba gear equipped with the present invention.

Turning first to FIG. 1, there is shown a diver 10 submerged in water 11, who is equipped with an open-circuit, two-stage, demand-operated underwater breathing apparatus. The breathing apparatus or scuba gear includes a tank 12 filled with a life-supporting gas such as compressed air. Atop the tank 12 is a first stage demand regulator valve 13 of known construction which leads air from the bottle 12 to a hose 14. The hose 14 supplies air at a reduced but still above-ambient pressure to a second stage regulator or demand valve 15 carried by the diver's mouth.

Figure 3:
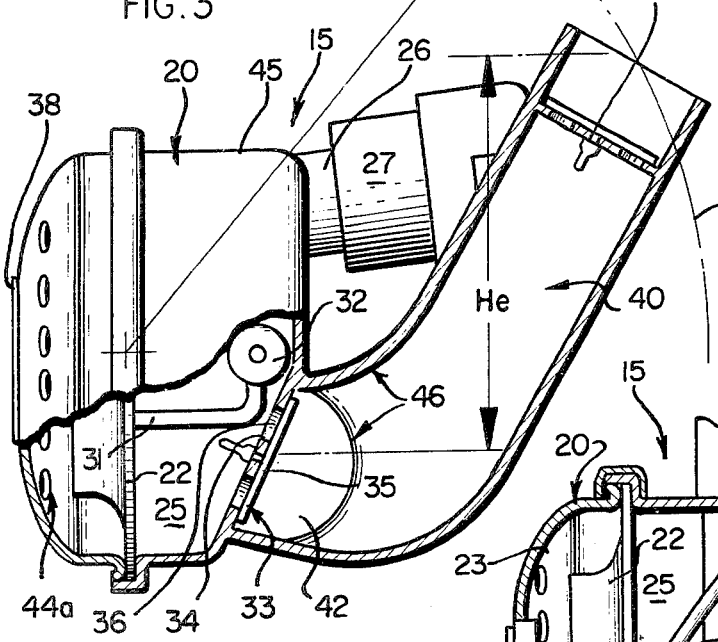
FIG. 3 is an elevational view of the diver's regulator as it appears when equipped with the present invention.
Figure 2:
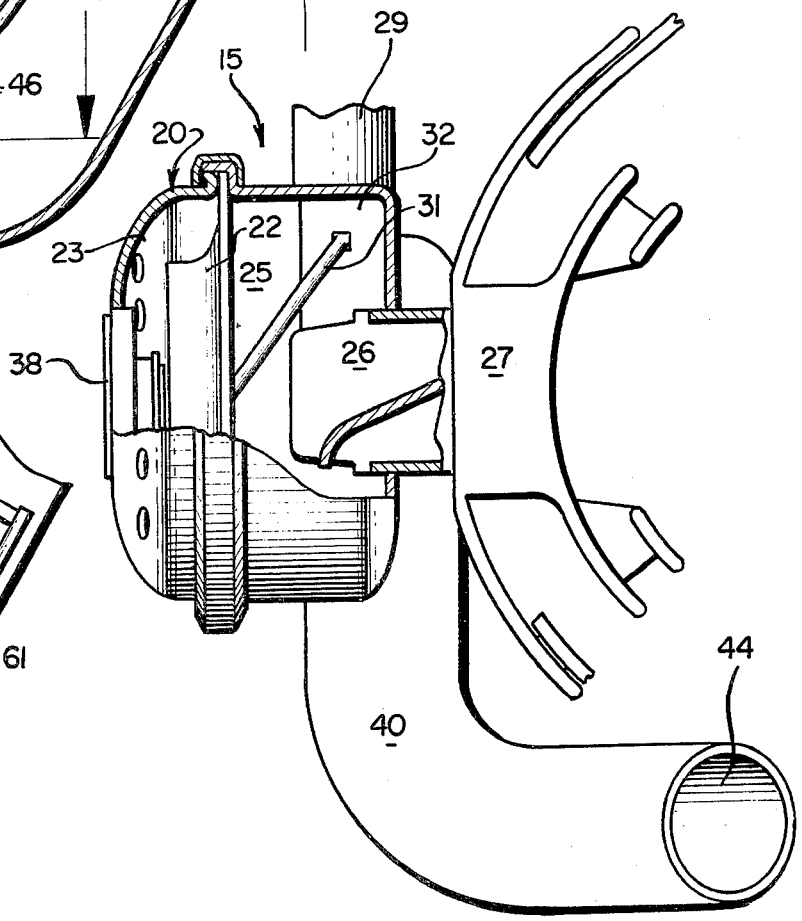
FIG. 2 is a top view of the diver's second stage regulator as it appears when equipped with one embodiment of the invention, parts of the regulator being broken away to show the regulator interior.

This second stage regulator 15 is shown in further detail in FIGS. 2, 3 and elsewhere. A typical second stage regulator is shown in U.S. Pat. No. 4,010,746 and in other U.S. patents. The present second stage regulator 15 comprises a housing 20 within which a diaphragm 22 is secured. This diaphragm 22 can be considered to divide the regulator into a first or water-side chamber 23 and a second or air-side chamber 25. A mouthpiece tube 26 is provided with a mouthpiece 27 having wings which can be grasped between the diver's teeth to hold the regulator in fluid communication with the diver's mouth. A fitting 29 secures the air-supplying hose 14 in gaseous communication with the air-side chamber 25 of the regular 20 so as to deliver air to the interior of that chamber 25.

In normal use, the diver holds the mouthpiece 27 in his mouth. When he inhales, the pressure in the air-side chamber or compartment 25 decreases below the ambient pressure experienced in the water surrounding the regulator, and which is present in the water-side chamber 23. This pressure imbalance causes the diaphragm 22 to move inwardly with respect to the air-side chamber 25, thereby at least slightly decreasing the volume of that chamber 25. This movement of the diaphragm 22 causes a valve arm 31 to move in a pre-designed direction. The valve arm 31 motion opens an air inlet valve 32 which admits air from the hose 14 into the air-side chamber 25. This now-admitted air can be inhaled by the diver from the air-side chamber 25 through the mouthpiece tube 26 and mouthpiece 27. When the diver ceases his inhalation effort, air pressure in the air-side chamber 25 gradually increases until that air pressure is substantially equal to the ambient water pressure surrounding the regulator and which is exposed to the water side of the chamber 23. This pressure equalization permits the diaphragm 22 to resume its original position, and the valve 32 then returns to its previous, valve-closed position, thereby terminating delivery of air to the air-side chamber 25.

When the diver exhales, he forces air through the mouthpiece 27 and mouthpiece tube 26 by the contraction of his lungs. This exhalation effort forces air into the air-side chamber 25 thereby raising the pressure experienced within that pressure chamber 25 above the pressure of the surrounding water. When such a pressure rise occurs, air within the chamber 25 is exhausted through a one-way regulator exhaust port check valve 33 here located at the bottom of the air-side chamber 25. Here, this one-way check valve 33 comprises one or more ports 34 which are normally covered by a flexible flap 35 made of rubber or other suitable material. A flap retainer 36 holds this flap 35 in a normally-closed position, as illustrated in FIG. 3, over the valve ports 34. When the air pressure within the valve-side chamber 25 rises, air is forced through these ports 34 and past the flap 35 into the surrounding water.

It will be understood that, should the regulator 20 become dislodged from the diver's mouth while the regulator and diver are submerged, the diver can quickly and easily resume regulator use by simply replacing the regulator mouthpiece 27 in its intended position within his mouth, and by then exhaling into the regulator mouthpiece 27. This exhalation effort will force water from the air-side chamber 25, thereby purging the air-side chamber 25 of any water and clearing it for further respiratory use. Alternatively, water or stale air can be exhausted from the air-side chamber 25 by depressing a purge button 38 carried in the illustrated position. Depressing the purge button 38 operates the valve lever arm 31 so as to deliver air directly into the air-side chamber 25 from the hose 14, thereby purging the chamber 25 of water or stale air as described above.

As indicated above, the diver effort in making the required breathing effort—particularly in the exhalation effort—can be reduced. To accomplish this exhalation breathing effort reduction in accordance with the invention, a gas barrier or conduit 40 (here, a tube which may be flexible) is attached for gas communication with the one-way regulator exhaust port check valve 33. This conduit 40 may be flexible but should be rigid enough to substantially retain the shape shown in the drawings so as to provide proper operation. The tube or conduit 40 extends from a conduit receiving end 42 to a conduit exhaust end or opening 44 which is here located above the exhaust port check valve 33. The conduit exhaust end 44 here is located above the top 45 of the second stage regulator 15 itself. Air forced through the regulator exhaust ports 34 is directed up through the conduit 40, causing the vertical displacement of water within the tube and forcing out water. In this way, an exhaust air flow path is established from the diver's lungs, through his mouth to the mouthpiece tube 26, and then through the chamber 25 and exhaust port 34 and up the conduit 40 to the conduit exhaust end or opening 44. This exhaust air flow path ends at a point above the exhaust path previously provided in scuba apparatus (which effectively ended at the exhaust port 34) and, indeed, above the top 45 of the second stage regulator 15 itself when the regulator and tube are oriented as shown in the common diver positions and regulator orientations.

It is well known that the ambient pressure found at any point in water is a function of the depth of that point from the water surface. For example, the pressure found at a depth of 33 feet from the water surface is 29.4 psia (14.7 psig), but the pressure found at a depth of one foot from the water surface is only approximately 15.2 psia (0.5 psig). Since the conduit exhaust end 44 is above any other point in the exhaust air flow path, the ambient pressure at the conduit exhaust end or opening 44 will be less than any other point in the exhaust path. Since exhausting or exhaled air seeks the point of least pressure, the exhaled air is in effect pulled from the diver if enough pressure reduction occurs, thereby greatly lessening (or eliminating altogether) the exhalation effort required of the diver.

The conduit 40 permits vertical displacement of water from the conduit interior in the most common diver orientations. This is accomplished by attaching the conduit 40 (by a pressure tight fit) over the regulator exhalation exit or exhaust valve of the second stage of the two-stage, single hose regulator so that a pressure tight exhaust air flow path can be established from the regulator exhaust exit and through the conduit interior. In general the conduit 40 has at least one opening with other openings covered by check valves to assure negative pressure capacity by prevention of ambient water inflow. The minimum number of check valves is thus one minus the number of openings. Conduit construction allows for the summated area perpendicular to exhaust flows to be the same as the equivalent interior of a ¼" to 2" diameter tube.

The main exhaust opening or openings 44 of the conduit 40 which permits exhaust venting to the ambient water can be thought of as being located on one quarter of an imaginary sphere S. The sphere center C is located near the diaphragm's center of pressure as shown in FIG. 3 and the sphere has a radius R between 0.1 and 10 times the regulator's functional cracking pressure.

Specifically, the maximum vertical component of R, where R is the distance from diaphragm center of pressure to conduit exhaust end or opening 44 as shown in FIG. 3, is such that, for a given regulator position, the equivalent column of water to produce a continuous free flow of regulator gases is not substantially less than the vertical component of the height of a column of displaced water in the air-side chamber 25, where the column extends from the diaphragm center of pressure to the regulator exhaust port check valve 33 exhalation point, plus the upward component of conduit height, extending from said exhalation point to the conduit exhaust 44 multiplied by the water clearing efficiency of the conduit. The functional cracking pressure can be expressed in centimeters as the height of that column of water required to exert enough force on the regulator second stage diaphragm to move the diaphragm 22, open the air inlet valve 32, and permit air flow to and through the regulator second stage 15 even with parallel pressure reduction. Typically, the functional cracking pressure (and consequently the radius R), are between about 0.5 cm and 30 cm.

The main conduit exhaust opening 44 is furthermore located in a sphere segment where the opening is vertically above the center of pressure of the diaphragm while the regulator is positioned in a diver normal, viewing-forward or parallel-to-the-water-surface position. The sphere segment surface extends from the above position to a corresponding position when the diver is viewing directly down. Naturally, the conduit exhaust opening or openings 44 are located in a side-to-side direction along the sphere surface so as not to interfere with the diver's face, face mask, field of vision, or comfort.

Other non-primary openings may be located at convenient locations on the conduit 40 to assure the exhaust venting during diver and regulator rolls and to prevent pressure buildup at exhalation start-up.

It will be noted that air being received in the chamber 25 during inhalation can find its way directly to the exhaust valve 33 and thence up the gas barrier or conduit 40. Under "free flow" conditions, air continuously enters the chamber 25, and just as continuously leaves the exhaust port 34. Rapid depletion of the diver's air supply can result. To overcome this, the air inlet valve mechanism 32 is constructed with a spring (not shown) or other device to bias the inlet valve 32 into a closed configuration. It is important, therefore, that in carrying out this aspect of the invention the effective conduit vertical height $H_e$, multiplied by the water clearing efficiency of the conduit in that position, must not be substantially greater than the head of an equivalent column of water sufficient to overcome the closure bias force on the inlet valve 32 and produce a continuous free-flow condition of the regulator valve. It will be understood that this free-flow condition begins when the cracking pressure of the regulator is overcome. In this way, regulator free flowing will be inhibited, yet maximum ease of diver exhalation effort will be obtained. An appropriate effective height $H_e$ has been found to be between 0.1 cm and 30 cm in the most common regulator orientations. To encourage free, stable, low-friction exhaust gas movement, the inner surfaces 46 of the conduit 40 may be smooth so as to present a horizontal or upwardly sloping surface to the exhaust when the regulator and invention are oriented for use by the diver when the diver is in the most common diving positions.

Figure 5:
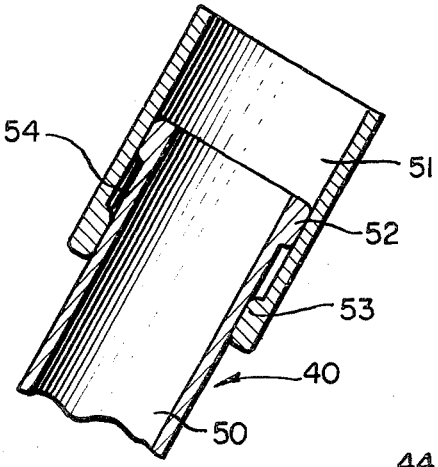
FIG. 5 is a fragmentary, sectional view similar to FIG. 4 but showing another variation of the invention.
Figure 10:
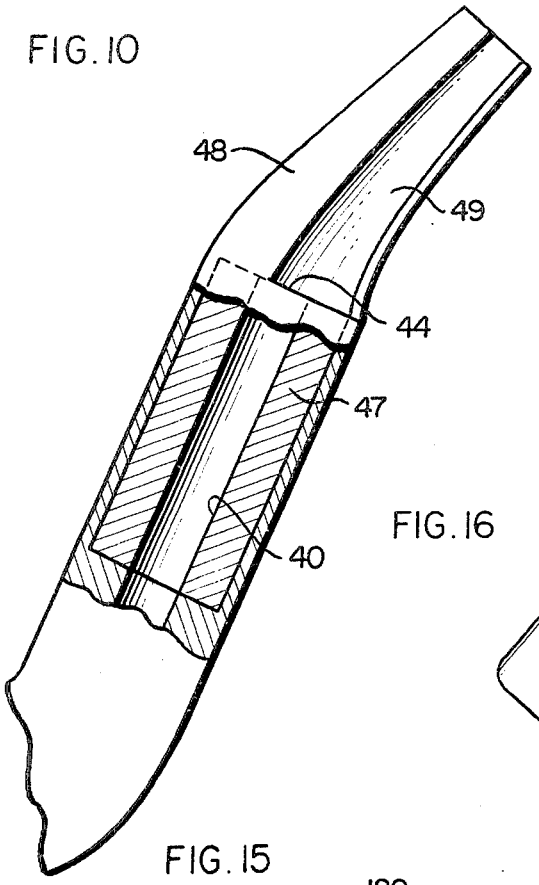
FIG. 10 is a fragmentary, sectional view similar to FIG. 7 showing still another variation of the invention.

In carrying out this aspect of the invention, it may be helpful to be able to adjust the amount of pressure reduction effected by the conduit 40. To this end, as shown in FIG. 5, the conduit 40 may include two or more telescoping members 50 and 51. When the distal telescoping member 51 is drawn upwardly, the effective height of the conduit 40 is extended. Mating stops 52 and 53 can be provided to prevent the distal member 51 from sliding off the proximate member 50, as can be envisioned from FIG. 5. When the members 52 and 53 are manufactured as shown, an air pocket 54 is created which will provide a resilient biasing force to act toward the extensions of the distal member 51, thereby providing the desired automatic extension effect. Extension may also be manually accomplished by pulling the distal member 51 outwardly; it will be held in place by friction between the members 50 and 51. As shown in FIG. 10, the interior of the conduit 40 can be provided with a compressible material 47. As the regulator 15 is taken to greater and greater depths by the diver, the ambient pressure (alternately of the exhaust air and water) increases, thereby compressing the material 47 and expanding the effective size of the conduit interior 40. In this way, the desired advantageous diver exhalation effort reduction can be better maintained.

To avoid diver discomfort, a bubble deflection element 48 can be attached at the exhaust outlet 44 of any of the embodiments of the novel conduit to encourage the channeling of exhaust bubbles away from the diver's ear. A gash-like opening 49 permits water to enter the device just above the usual exhaust opening 44 so as to prevent regulator free-flow conditions.

Figure 6:
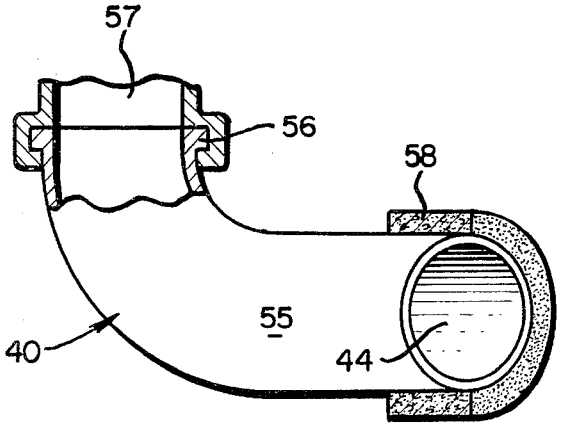
FIG. 6 is a fragmentary, sectional view similar to FIG. 5 but showing yet another variation of the invention.
Figure 8:
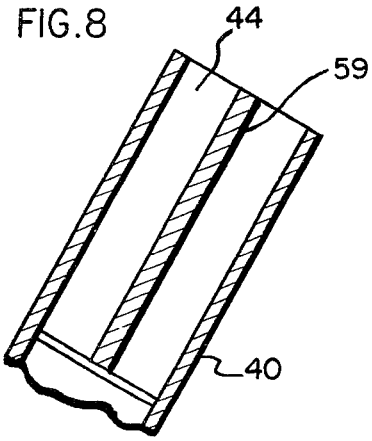
FIG. 8 is a fragmentary, sectional view similar to FIG. 5 showing yet another variation of the invention.
Figure 9:
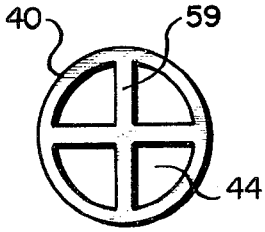
FIG. 9 is a top view showing another aspect of the invention variation in FIG. 8.

As the previous discussion makes apparent, it is helpful for the conduit 40 to be oriented in an upwardly-extending direction. In keeping with this aspect of the invention, then, and as shown in FIG. 6, the conduit 40 can include a distal portion 55 mounted by a swivel structure 56 to a proximate member 57. A bouyant element 58 mounted near the exhaust opening 44 encourages the distal conduit portion 55 to assume an upwardly-extending orientation. If desired, a bubble shredding device 59 such as that shown in FIGS. 8 and 9 can be provided to increase the surface area and reduce flow cross sectional area inside the conduit 40 so as to aid in reducing pressure by superior water clearing characteristics.

It will be observed that the conduit 40 may fill with water between diver exhalations. When so filled, the water must be expelled, or forced out, before low-effort exhalation can occur. To obviate this initial diver effort, a check valve 60 can, if desired, be positioned near the exhaust end or opening 44 of the conduit. This check valve operates to prevent the ingress of fluid into the conduit 40 and regulator valve 15 during the demand inhalation phase of a breathing cycle without substantially affecting pressure reduction capabilities.

Figure 4:
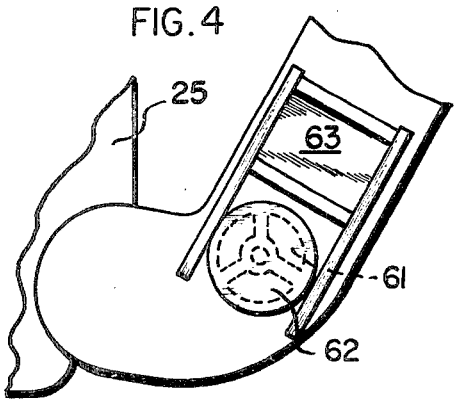
FIG. 4 is a fragmentary view of a portion of the invention shown in FIGS. 2 and 3, but showing a variation of the present invention.

Easy water explusion can also be encouraged by functionally locating a choke port 61 between the regulator exhaust port 34 and the conduit exhaust opening 44, as will be understood by referring to FIGS. 3 and 4. A check valve 62 can be associated with the choke port 61 to permit the egress of exhaust gas and water as the exhalation phase of the breathing cycle begins, but not the ingress of water into the system during the pressure-reduced phase of the breathing cycle. More than one check valve opening may be used to provide exhaust venting during rolls or pitches of the regulator. Inner conduit surfaces 46 can channel exhaust, in a given regulator position, to a given port covered by a check valve.

Figure 7:
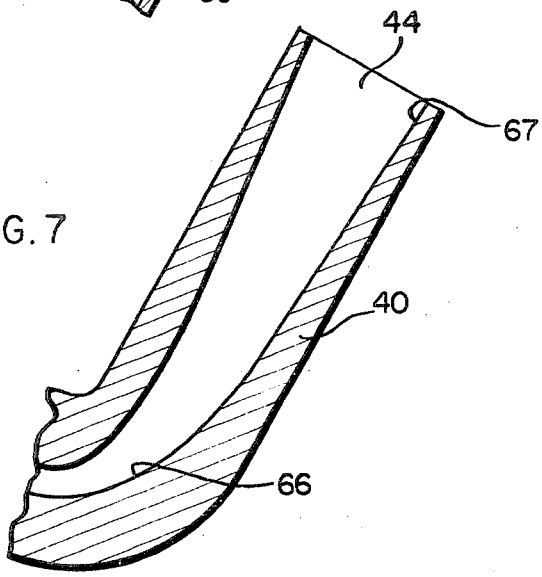
FIG. 7 is a fragmentary, sectional view similar to FIG. 5 but showing still another variation of the invention.

If desired, a slide or other mechanism 63 can be associated with the choke port 61 (with or without the check valve 62) to adjust the effective size of the choke port and consequently adjust the choke port effect, by allowing ambient-pressure water to enter the conduit 40 at this point. Water explusion effort can also be eased by forming the conduit 40 so as to define a tapered gas passage cross-sectional area 66 which is smaller than the cross-sectional area 67 defined adjacent the conduit exhaust port 44, as shown in FIG. 7.

It will be understood that many regulators 15 of the type shown in FIGS. 2 and 3 and 11–13 come equipped with exhaust manifolds leading in a generally horizontal direction away from the exhaust valve 33. These exhaust manifolds have little if any effect on breathing exhalation effort reduction. It is to be specifically understood that the novel breathing effort reduction device 40 can be offered in a form which permits easy attachment to such an exhaust manifold without departing from the spirit and scope of the invention.

Figure 11:
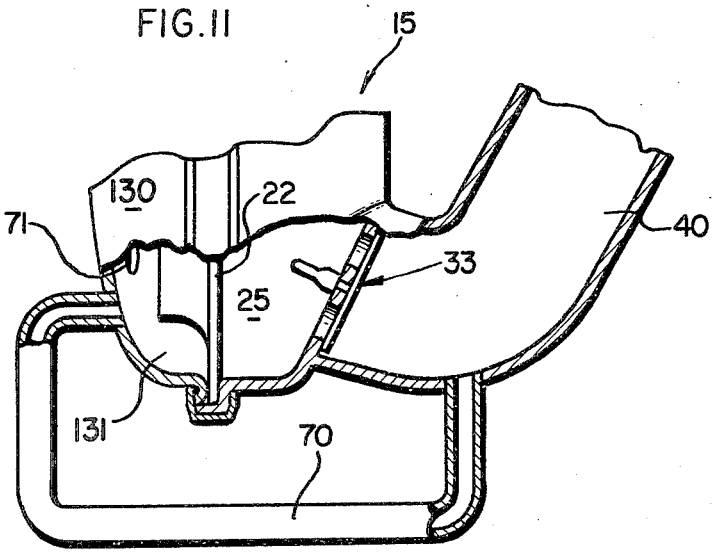
FIG. 11 is a fragmentary, elevational view in partial section showing a further variation of the invention.
Figure 12:
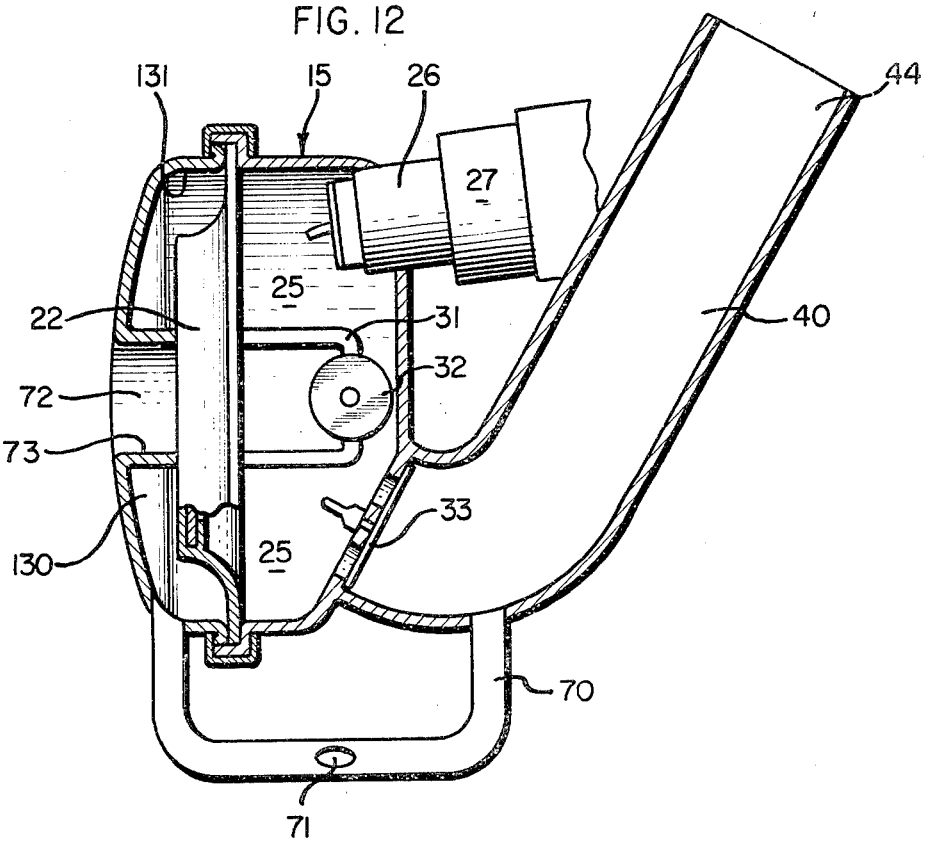
FIG. 12 is a fragmentary, elevational view in partial section similar to FIG. 10.
Figure 13:
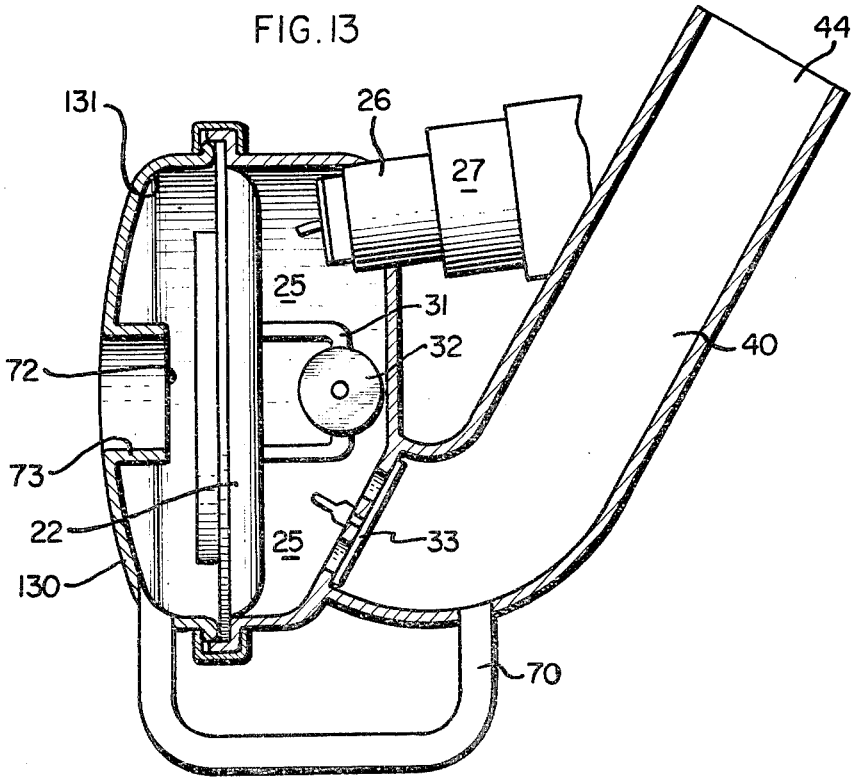
FIG. 13 is a fragmentary, elevational view in partial section similar to FIGS. 10 and 11.

In accordance with another aspect of the invention, regulator performance (that is, pressure reduction without regulator free flow) can be further improved by installing at least a negative pressure tight covering 130 over the water side of the diaphragm 22 so as to form a water side chamber 131 and, by connection, a branch tube or passage 70 to a pressure reduced zone, beyond the regulator exhalation check valve 33 as shown in FIGS. 11–13. When a regulator so equipped is used, air pressure reduction occurs in the air-side chamber 25 and consequently exhalation effort is eased as previously described. The branch tube or connecting passage 70 draws pressure from the water side chamber 131 to a point downstream from a regulator exhaust valve during diver exhalation. In this way, there is minimized any tendency of the diaphragm 22 and air-admission inlet valve 32 to assume air-admitting free-flowing configurations. To ease effects of parallel pressure reduction, if desired, a port 71 may be formed in parallel of the reducer covering 130 or in the branch tube 70 (see FIGS. 11–13). A flushing tube 73 may also be provided to allow ambient water flow into reduced pressure zones adjacent to the diaphragm 22, thus lessening reduced pressure on the waterside of the diaphragm 22. Here the waterside chamber 131 is closed, except for the port 72 defined in the end of the flushing tube 73 and connecting passage 70.

A flushing tube valve comprises a flushing tube 73 formed through the parallel covering 130; it functionally seals against the regulator diaphragm 22 in the exhalation or rest position of the diaphragm. Initial inhalation pressure is dependant on pressure reduction and the diaphragm area exposed to said reduction, until the diaphragm moves away from the flushing tube end 72, allowing ambient water into the water side of the regulator and halting parallel pressure reduction.

Figure 14:
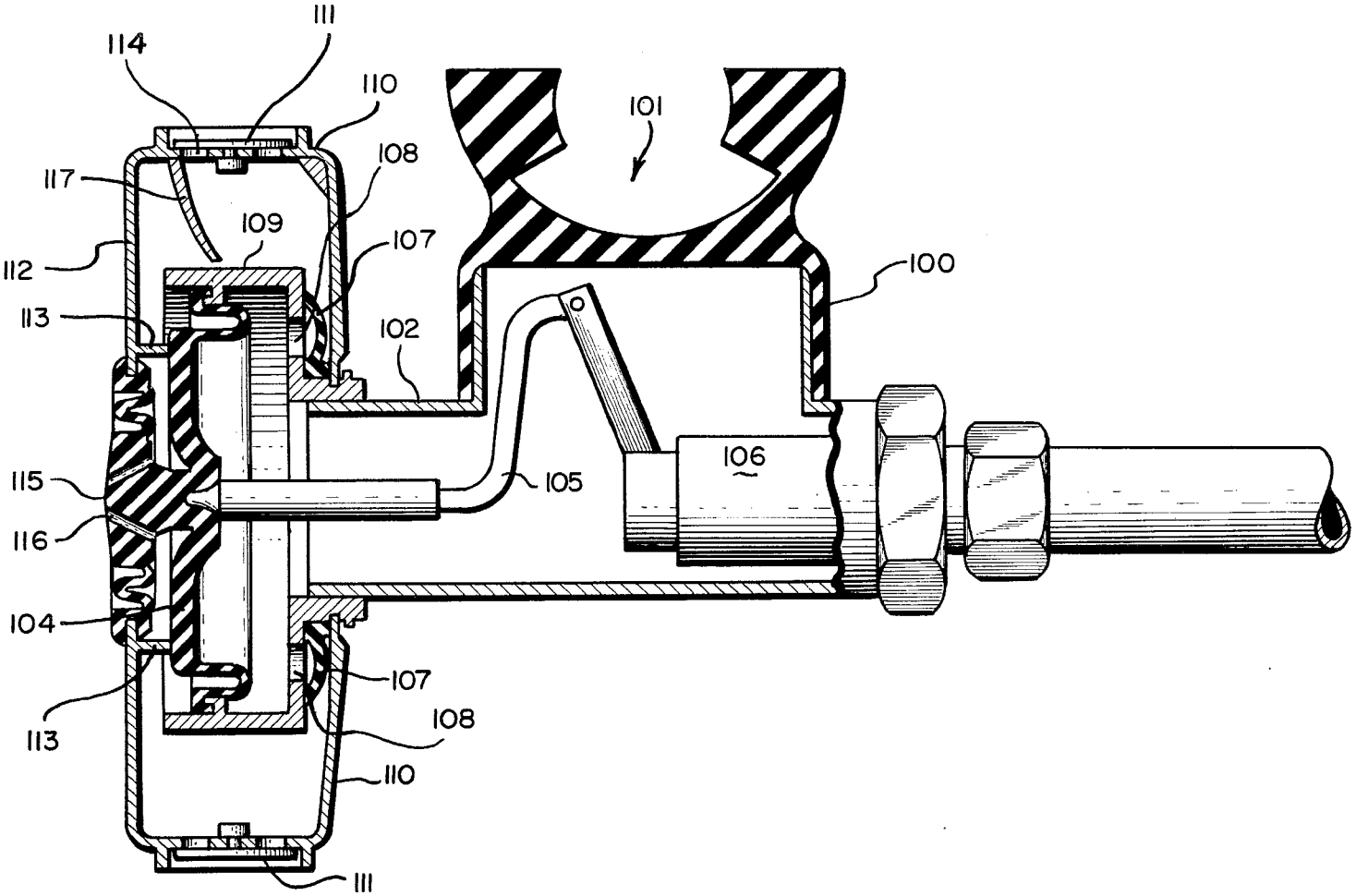
FIG. 14 is a sectional view of yet another form of scuba regulator equipped with a modified version of the invention.

FIG. 14 shows a regulator 100 of the "poseidon" type. Here, air is inhaled and exhaled from mouth piece 101 and tube 102. Inhalation draws a diaphragm 104 inwardly, or to the right as shown in FIG. 14. This movement operates a linkage 105 so as to open an air-supply valve 106. Exhalation pressures force the diaphragm 104 to the left and operate the linkage 105 to close the air-supply valve 106. Further exhalation forces exhaust gases out one-way valves 107 mounted over ports 108 formed in a cup 109 which mounts the diaphragm 104. Here, a gas barrier or conduit dome 110 is provided with check ports 111 to direct exhaust gas to whatever conduit end port 114 is located at the top of the dome 110.

Here in FIG. 14, together with the gas barrier dome 110 is an extension passage wholly communicating pressure to the parallel pressure covering 112, covering a portion of the diaphragm 104 permitting parallel pressure reduction over the area of the diaphragm 104. Along with the parallel pressure reduction described here, a flushing tube 113 has been incorporated, as previously described, to elevate initial inhalation starting pressure caused by parallel pressure reduction. Here ports 116 extending through the purge button 115 provide ambient water pressure access to the flushing tube 113. It will be understood that the baffles 117 act as shredding surfaces similar to the surfaces 59 described previously.

Figure 16:
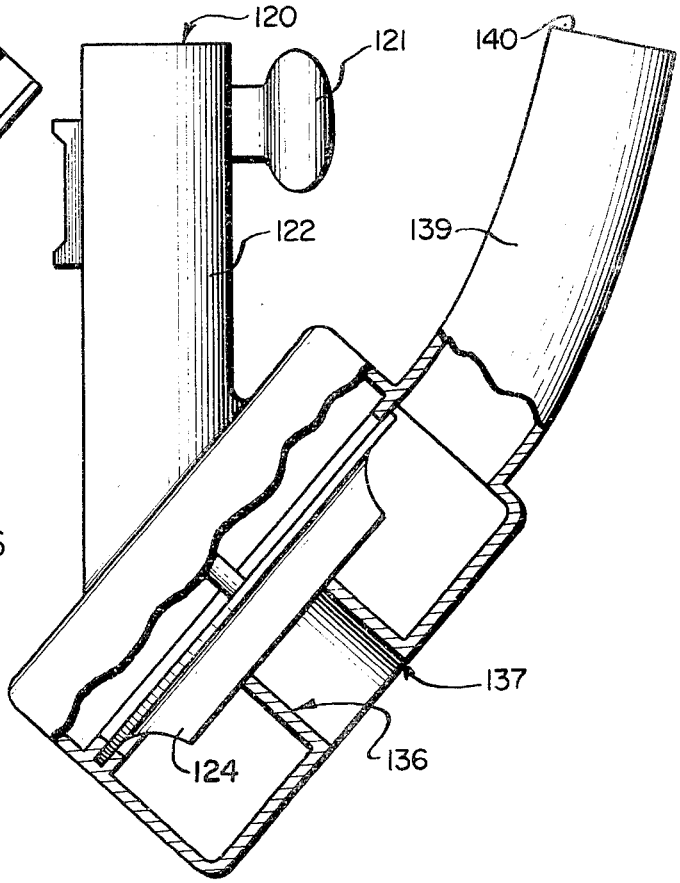
FIG. 16 is a side elevational view in partial section similar to FIG. 15 but showing another version of the invention.
Figure 15:
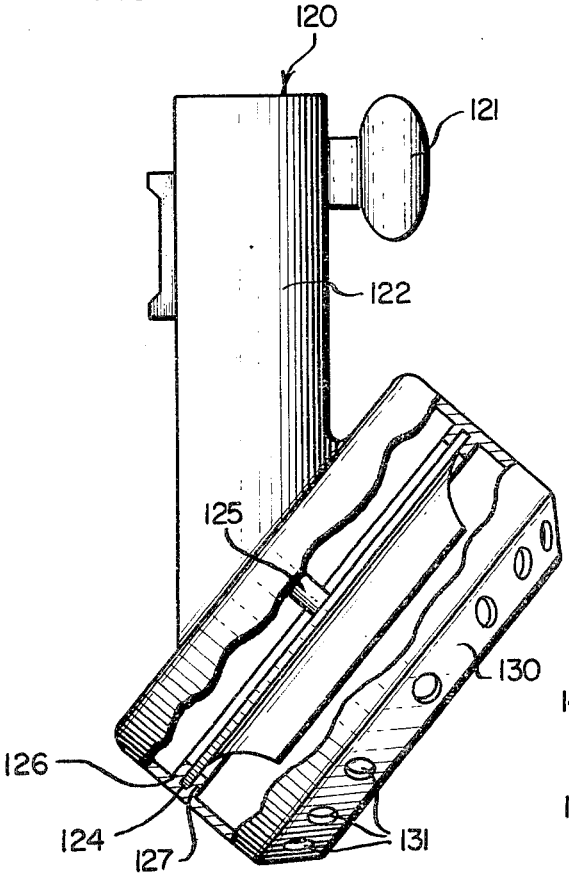
FIG. 15 is a side elevational view in partial section of still another form of scuba regulator equipped with a modified version of the invention.
Figure 17:
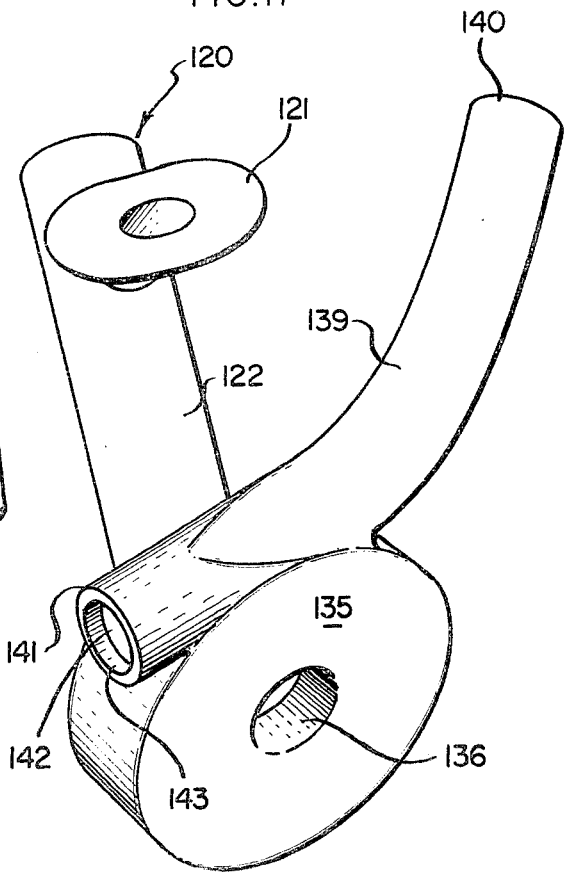
FIG. 17 is a rear elevational view of the regulator and invention embodiments shown in FIG. 16.

FIGS. 15–17 shows a regulator 120 of the "pilot" type. Here, air is inhaled and exhaled from a mouthpiece 121 and tube 122. Inhalation draws a diaphragm 124 inwardlly, or to the left, in FIGS. 15 and 16. This movement operates a plunger 123 so as to open an air-supply valve (not shown). Exhalation forces the diaphragm 124 to the right, and away from a seat 126. The diaphragm is loosely held in position by snap ring 127. In this way, air can flow around the diaphragm and out of the regulator 120.

In the embodiment of the invention shown in FIG. 15, a gas barrier or conduit dome 130 is provided with check-valve-equipped ports 131 to direct exhaust gas to whatever port 131 is located at the top of the dome 130 and above the diaphragm 124 and plunger 125.

In the embodiment of the invention shown in FIGS. 16 and 17, a dome 135 is provided with a flushing tube 136 which terminates in a distal port 137. This flushing tube encourages the dynamic application of water against the diaphragm 124 when inhalation occurs, and can be considered to be similar to the flushing tube 73 shown in FIGS. 12, 13 and 14. A reducing exhaust conduit 139 terminates in an exhaust port 140. The location of this exhaust port can be determined with reference to the imaginary sphere segments a and effective height $H_e$ described in connection with FIG. 3. If desired, a small secondary conduit 141, exhaust opening 142 and check valve 143 can be provided to ease the initiation of diver exhalation and pressure reduction during diver roll and pitch movement.

I claim:

1. An improved underwater breathing demand regulator device, comprising, in combination, a housing having, in normal use, a top portion and a bottom portion, the regulator device having a mouthpiece extending from the housing top portion and an exhaust port aperture defined in the housing bottom portion, a one-way exhaust valve communicating with the exhaust port, a valve reactor diaphragm in the housing located apart from the one-way exhaust valve, and being adapted to separate space inside the housing into an air chamber and a water chamber, an air inlet valve responsive to movement of the diaphragm for admitting pressurized air to the air chamber for flow to the mouthpiece, biasing means providing a predetermined biasing force on said inlet valve to urge said inlet valve into a closed configuration at any given level below the water surface, whereby a counteracting force on said diaphragm slightly greater than said predetermined biasing force on said inlet valve is required to open said inlet valve and provide a continuous free flow of gas into said air chamber, the improvement comprising a pressure-resistant conduit means directly connected to the exhaust port aperture and extending, when the regulator is in normal use, in an upward direction therefrom to terminate at a conduit exhaust aperture means located, during normal regulator use, above the exhaust port aperture at a predetermined vertical distance, said pressure resistant conduit means providing a continuous and unobstructed flowpath from said exhaust port to said exhaust aperture means, whereby the flow of exhaust air through the air chamber, the exhaust port aperture and up and out of the conduit at the conduit exhaust aperture means acting to create a predetermined siphon-effect suction pressure in the air chamber and a corresponding predetermined negative force on the diaphragm related to the vertical extent of the conduit which is at least slightly less than the positive force on the diaphragm caused by the baising means of the inlet valve.

2. An improved underwater breathing demand regulator device according to claim 1 wherein said conduit exhaust aperture means is located substantially in a horizontal plane intersecting said mouthpiece.

3. An improved underwater breathing demand regulator device, comprising, in combination, a hollow housing, having in normal use, a top portion and a bottom portion, a valve reactor diaphragm within the housing and dividing the housing interior into a water chamber and an air chamber, an air inlet valve responsive to movement of the diaphragm for admitting pressurized air to the air chamber, biasing means providing a pedetermined biasing force on said air inlet valve to urge said inlet valve into a closed configuration at any given level below the water surface, whereby a counteracting force on said diaphragm slightly greater than said predetermined biasing force on said inlet valve is required to open said inlet valve and provide a continuous free flow of gas into said air chamber, a mouthpiece communicating with the air chamber for permitting air to be inhaled from the air chamber and permitting air to be exhaled into and through the air chamber into the surrounding water, and an exhaust port aperture being formed in the air chamber, the aperture being covered by a one-way check valve to permit exhaust air to escape from the air chamber, but to inhibit the flow of water into the air chamber, the improvement comprising a pressure-resistant conduit means directly connected to the exhaust port aperture and extending, when the regulator is in normal use, in an upward direction therefrom to terminate at a conduit exhaust aperture means located, during normal regulator use, above the exhaust port aperture at a predetermined vertical distance, said pressure resistant conduit means providing a continuous unobstructed flowpath from said exhaust port to said exhaust aperture means, whereby the flow of exhaust air through the air chamber, the exhaust port aperture and up and out of the conduit at the conduit exhaust aperture means acting to create a predetermined siphon-effect suction pressure in the air chamber and a corresponding predetermined negative force on the diaphragm related to the vertical extent of the conduit which is less than the positive force on the diaphragm caused by the biasing means of the inlet valve.

4. A device according to claim 1 or 3 including check valve means associated with said conduit and exhaust valve to prevent the ingress of fluid into the conduit or air chamber during the demand inhalation phase of a breathing cycle.

5. A device according to claim 1 or 3 wherein said conduit is partially defined by interior surfaces, said interior surfaces being smooth to encourage the easy passage of exhaled gas through the conduit.

6. A device according to claim 1 or 3 wherein said conduit defines a choke port functionally located between said valve exhaust port and said conduit exhaust end.

7. A device according to claim 4 including a check valve means associated with said choke port to permit the egress of gas and water through the choke port during an initial portion of the exhalation phase of a breathing cycle and to prevent ingress of water into the conduit during a subsequent, reduced-pressure portion of the exhalation phase of a breathing cycle.

8. A device according to claim 4 including means for adjusting the size of said choke port.

9. A device according to claim 1 or 3 wherein said conduit includes a plurality of telescoping conduit members.

10. A device according to claim 1 or 3 including compressible bouyant material carried by the conduit to encourage the conduit to assume an upwardly extending orientation when the conduit is submerged in water.

11. A device according to claim 1 or 3 including compressible material within the conduit arranged to define an exhaust passage, the compressible material being progressively compressed at progressively greater depths of water to progressively expand the effective size of the conduit exhaust cross-sectional area and thereby ease diver exhalation effort.

12. A device according to claim 1 or 3 including bubble deflector means for directing exhaust bubbles from the conduit opening away from the diver's ear.

13. A device according to claim 1 or 3 including means for maintaining the conduit in an upwardly extending position regardless of the orientation of the valve and the valve user.

14. A device according to claim 1 or 3 including gas flow shredding surfaces extending across the conduit to divide the conduit into a plurality of gas flow divisions.

15. A device according to claim 1 or 3 wherein said conduit includes a tapered portion defining a cross-sectional gas passage area larger than the cross-sectional gas passage area defined by the conduit adjacent the valve exhaust port.

* * * * *